US007785236B1

(12) United States Patent
Lo

(10) Patent No.: US 7,785,236 B1
(45) Date of Patent: Aug. 31, 2010

(54) EXERCISER HAVING MAGNETS ADJUSTING DEVICE

(76) Inventor: Chiu-Hsiang Lo, No. 1, Ln. 160, Sec. 2, Tanfu Rd., Tanzi Township, Taichung County (TW)

( * ) Notice: Subject to any disclaimer, the term of this patent is extended or adjusted under 35 U.S.C. 154(b) by 0 days.

(21) Appl. No.: 12/548,457

(22) Filed: Aug. 27, 2009

(30) Foreign Application Priority Data

Jun. 18, 2009 (TW) ..... 98210942 U

(51) Int. Cl.
*A63B 22/06* (2006.01)

(52) U.S. Cl. ..... 482/63; 482/57

(58) Field of Classification Search ..... 482/4–7, 482/51, 57, 63, 64, 114, 115, 118, 119, 903
See application file for complete search history.

(56) References Cited

U.S. PATENT DOCUMENTS 5,145,480 A * 9/1992 Wang ..... 482/63
5,310,392 A * 5/1994 Lo ..... 482/63
5,324,242 A * 6/1994 Lo ..... 482/63
5,466,203 A * 11/1995 Chen ..... 482/63
6,095,953 A * 8/2000 Lee et al. ..... 482/57
6,569,063 B2 * 5/2003 Chen ..... 482/63
6,964,633 B2 * 11/2005 Kolda et al. ..... 482/63
7,004,888 B1 * 2/2006 Weng ..... 482/57
7,011,607 B2 * 3/2006 Kolda et al. ..... 482/57
7,364,533 B2 * 4/2008 Baker ..... 482/57
2005/0020410 A1 * 1/2005 Chang ..... 482/63

* cited by examiner

*Primary Examiner*—Loan H Thanh
*Assistant Examiner*—Allana Lewin

(57) ABSTRACT

The present invention discloses an exerciser having magnets adjusting device, which comprises a frame assembly, a flywheel, a driving assembly, a power transmission mechanism and a magnets adjusting device. The magnets adjusting device includes a guiding rail, a sliding unit with magnetic units, and a control mechanism. The guiding rail is fixed on the frame assembly. The sliding unit is mounted on the guiding rail so that the sliding unit and the magnetic units can be linearly moved along the guiding rail. The control mechanism controls the reciprocated movement of the sliding unit and the magnetic units linearly close to or away from the axis of the flywheel. Whereby, to improve the stability of the adjusted variable damping and accurately calculate the corresponding resistance after the adjustment, and to enhance the durability of the machine can be achieved.

14 Claims, 9 Drawing Sheets

EXERCISER HAVING MAGNETS ADJUSTING DEVICE

FIELD OF THE INVENTION

The present invention relates to an exerciser having magnets adjusting device, particularly to a magnets adjusting device with magnetic units of which can be linearly moved close to or away from the flywheel to adjust the magnetic resilience acted on the flywheel.

BACKGROUND OF THE INVENTION

According to the prior arts of exercisers, they basically comprise a frame assembly, a flywheel, a driving assembly and a power transmission mechanism. Reciprocation between the driving assembly and the flywheel is done through the power transmission mechanism. Inasmuch as the force applied by users is transmitted from the driving assembly, passed through the power transmission mechanism and then acted on the flywheel, the flywheel can be rotated correspondingly to the frame assembly. The prior arts of exercisers, used for increasing the workload of users to reach the goal of doing exercise, usually have a magnets adjusting device such as those disclosed in the U.S. Pat. No. 5,145,480, U.S. Pat. No. 5,310,392, U.S. Pat. No. 5,324,242, and U.S. Pat. No. 6,569,063. A magnets adjusting device mainly includes magnetic units and a movement control unit. The movement control unit can adjust the magnetic units to approach the flywheel and make the flywheel reciprocate with the magnetic units (so called cut across the magnetic field) to bear the resistance in order to achieve the objective of increasing workload for users.

Somehow, certain disadvantages from the design of the prior arts occur in their embodiments stated as below:

1. The mechanism of certain prior arts includes a slider with a U-shaped horizontal cross-section. There is a set of magnetic units on each side of the slider, and each set of the magnetic units is facing toward both sides of a flywheel. In order to avoid the inner surface of the slider contacting with the edge of the flywheel, either the moving range of the magnet units, corresponding to the flywheel, must be narrowed that it causes a disadvantage of reducing the adjusting range of resistance, or the size of the slider must be increased that it causes another disadvantage of increasing the production cost as well.

2. The mechanism of certain prior arts doesn't have a smoother sliding element. When the movement of the magnetic units is adjusted, it will cause disadvantages, such as inaccurate calculation of the resistance and damage of components, due to the unsmooth sliding.

3. The mechanism of certain prior arts is lack of a stable magnets adjusting device and a corresponding signal process unit. The resistance can not be accurately adjusted and displayed to meet users' need inasmuch as the variation of the resistance can not be effectively and accurately measured without a signal process unit.

Because the prior arts have above disadvantages and should be improved, the inventor of the present invention, with many years' experience of development on exercisers, devotes himself to experiment and improve prior designs. The present invention is made a better product to achieve the following objectives.

SUMMARY OF THE INVENTION

The first objective of the present invention is to provide an exerciser with an improved magnets adjusting device which makes magnetic units linearly and smoothly move along the radial of a flywheel, in order to enhance the convenience and stability of manipulation in terms of the variation of resistance damping and, on the other hand, to improve the durability by avoiding the damage of components. The technique to achieve above objective of the present invention applies a magnets adjusting device which includes a linearly extended guiding rail, a sliding unit and a control mechanism. The guiding rail equipped with rollers is fixed on a frame assembly and the sliding unit is mounted on the guiding rail to linearly move against each other through the rollers. In the mean time, there are magnetic units fixed on the sliding unit, so the magnetic units can be linearly moved with the sliding unit along the guiding rail. The control mechanism is applied to control the reciprocating movement of the sliding unit along the guiding rail; as a result, the magnetic units are able to smoothly move close to or away from the axis of the flywheel.

The second objective of the present invention is to provide a magnets adjusting device of an exerciser capable to accurately measure the movement, corresponding to the flywheel, of the magnetic units by accurately calculating the responded resistance for the magnets adjusting device. The technique to achieve above objective of the present invention applies a fixed rack on the sliding unit and a variable resistor on the frame assembly. The variable resistor has a spindle whose front shaft has a fixed gear wheel engaged with the rack. When the sliding unit and the rack are moved corresponding to the variable resistor, the rack will make the spindle to spin through the drive from the gear wheel and change the value of the variable resistor. It generates a voltage signal for the signal process unit to measure the movement, corresponding to the flywheel, of the magnetic units on the sliding unit, and then the value of the resistance can be accurately calculated, based upon the measurement of the movement, to be shown on the display.

The third objective of the present invention is to provide a magnets adjusting device of an exerciser capable of stably controlling the variation of the resistance. The technique to achieve above objective of the present invention applies a control mechanism including a housing fixed on the frame assembly, a lever and a spring allocated on the housing, and at least one rubber ring set between the housing and the lever. The rubber ring causes the housing and the lever to possess a resilience which is greater than the elastic force of the spring. The lever is interlinked with the sliding unit through a steel rope and both ends of the spring are connected to the frame assembly and the sliding unit respectively.

DETAILED DESCRIPTION OF THE PREFERRED EMBODIMENT

Figure 1:
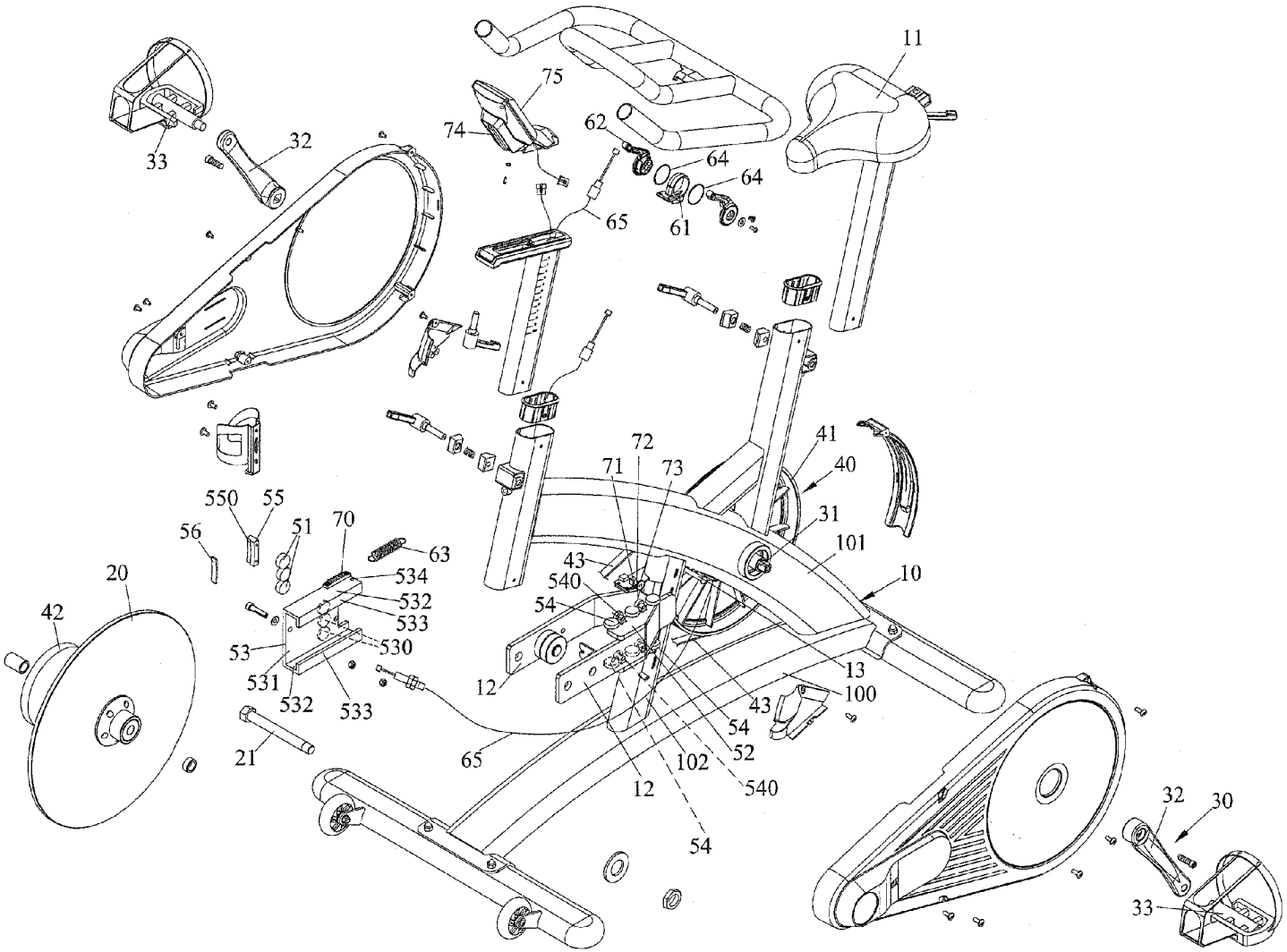
FIG. 1 is an exploded schematic drawing of the present invention.

Referring to FIGS. 1 and 5-7, the present invention improves the magnets adjusting mechanism for an exerciser. The basic structure of a regular exerciser includes:

a frame assembly 10 allowing the exerciser to be firmly placed on a horizontal surface;

a flywheel 20 with a front shaft 21 to be rotatably mounted on the frame assembly 10;

a driving assembly 30 allowing reciprocal force to be applied by users;

a power transmission mechanism 40, with one power-input end linked with the driving assembly 30 and one power-output end linked with the flywheel 20, allowing the force applied by users to be transferred by the driving assembly 30, through the power transmission mechanism 40 to the flywheel 20, and the flywheel 20 to be rotated corresponding to the frame assembly 10; and a magnets adjusting device 50 having at least a magnetic unit 51 near the flywheel 20 which will reciprocate with the magnetic unit 51 to generate magnetic damping while rotating against the magnetic unit 51 and will bear the resistance to increase the workload for users to reach the goal of doing exercise.

Figure 2:
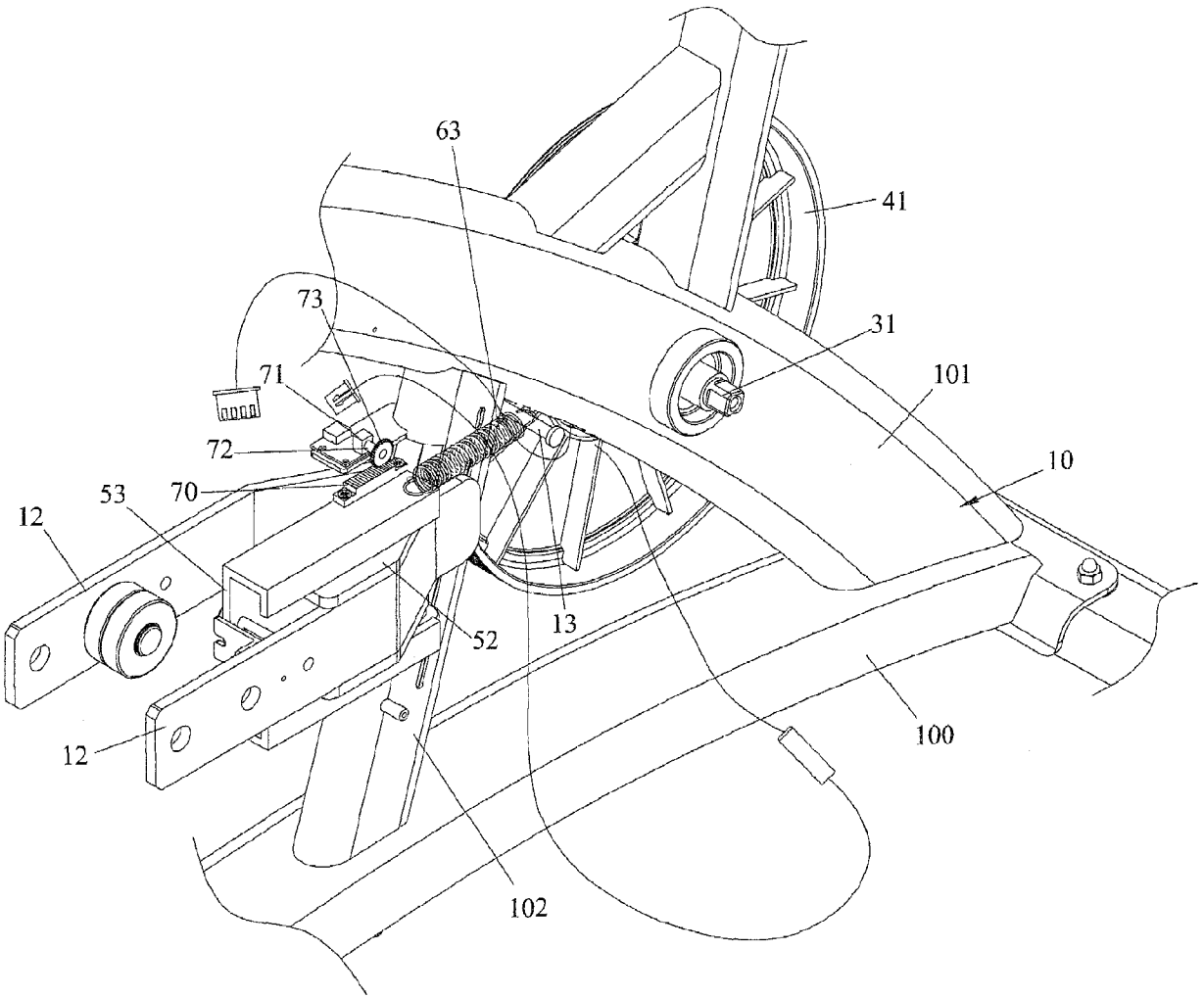
FIG. 2 is an assembled fragmentary schematic drawing of the present invention.
Figure 3:
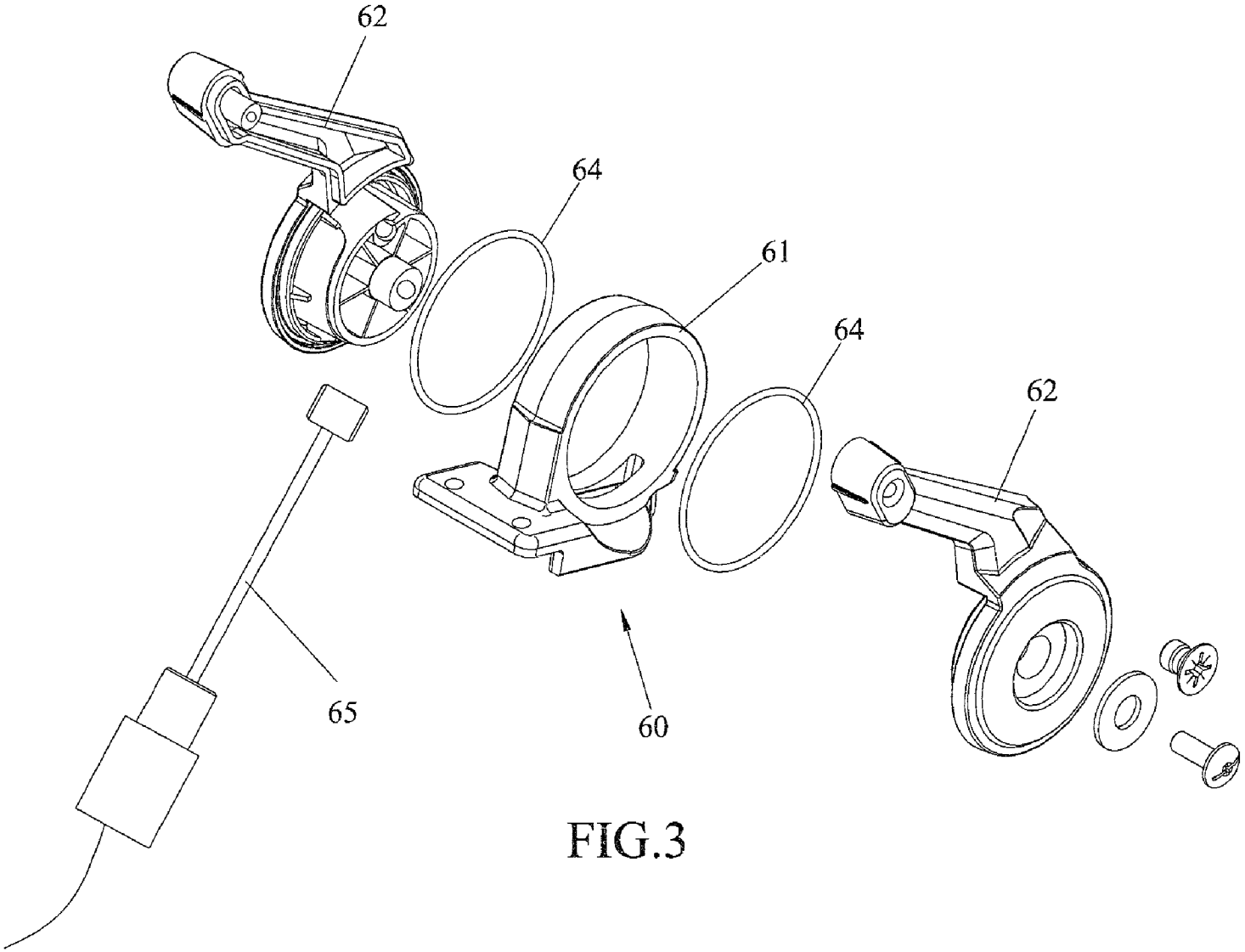
FIG. 3 is an enlarged exploded fragmentary schematic drawing of the control mechanism of the present invention.
Figure 4:
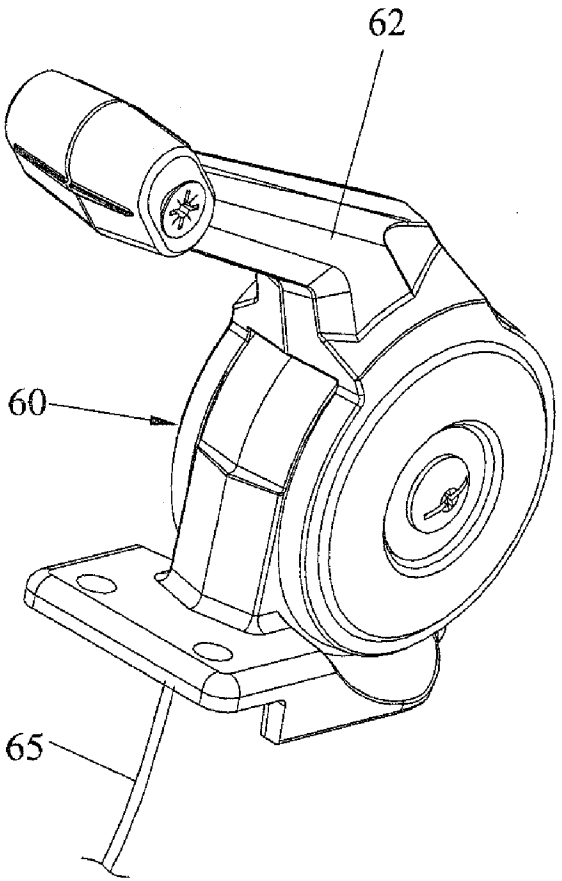
FIG. 4 is an enlarged assembled fragmentary schematic drawing of the control mechanism of the present invention.
Figure 5:
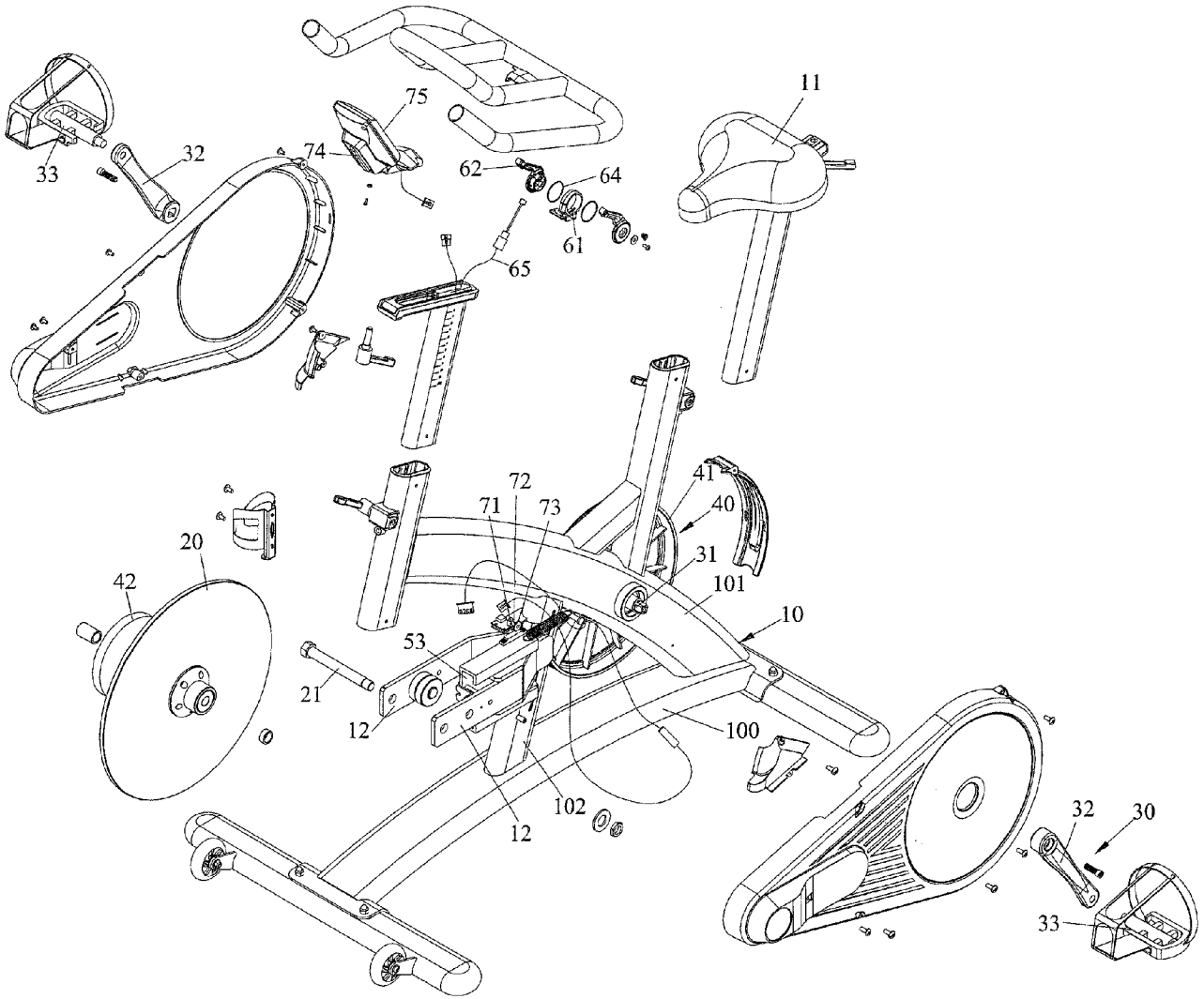
FIG. 5 is an assembled fragmentary schematic drawing of the present invention.
Figure 6:
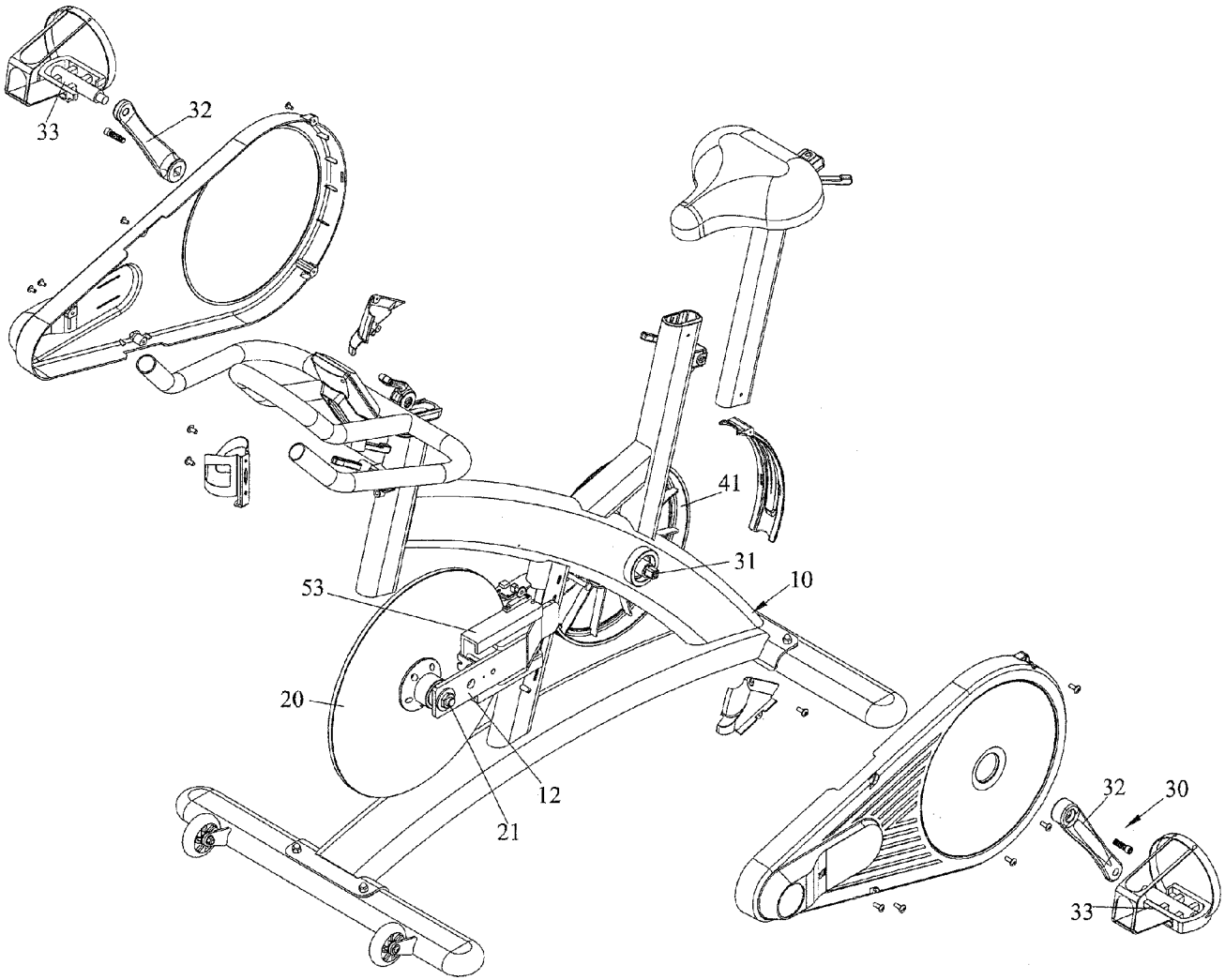
FIG. 6 is another assembled fragmentary schematic drawing of the present invention.

The present invention improves the design of the magnets adjusting device which makes magnetic units linearly and smoothly move along the radial of a flywheel in order to enhance the convenience and stability of manipulation in terms of the variation of damping and, on the other hand, to improve the durability by avoiding the damage of components. Referring to FIGS. 1 to 3, the embodiments of the magnets adjusting device include a linearly extended guiding rail 52 fixed on the frame assembly 10;

a sliding unit 53, with magnetic units 51 fixed on it which is mounted on the guiding rail 52 and is able to slide and move along the guiding rail 52, enabling the magnetic units 51 to linearly move along the guiding rail 52 with the sliding unit 53, wherein an embodiment of fixing the magnetic units 51 that are magnets on the sliding unit 53 which is designed with cylindrical troughs 530 to agglutinate and fix the magnetic units 51 onto the cylindrical troughs 530 by applying adhesive on one side of each magnetic units 51 and on the cylindrical troughs 530 of the sliding unit 53 in order to effectively and firmly fix the magnetic units 51 on the sliding unit 53; and a control mechanism 60 utilized to control the reciprocated movement of the sliding unit 53 along the guiding rail 52, and to control the magnetic units 51 to be linearly moved close to or away from the axis of the flywheel 20.

Figure 7:
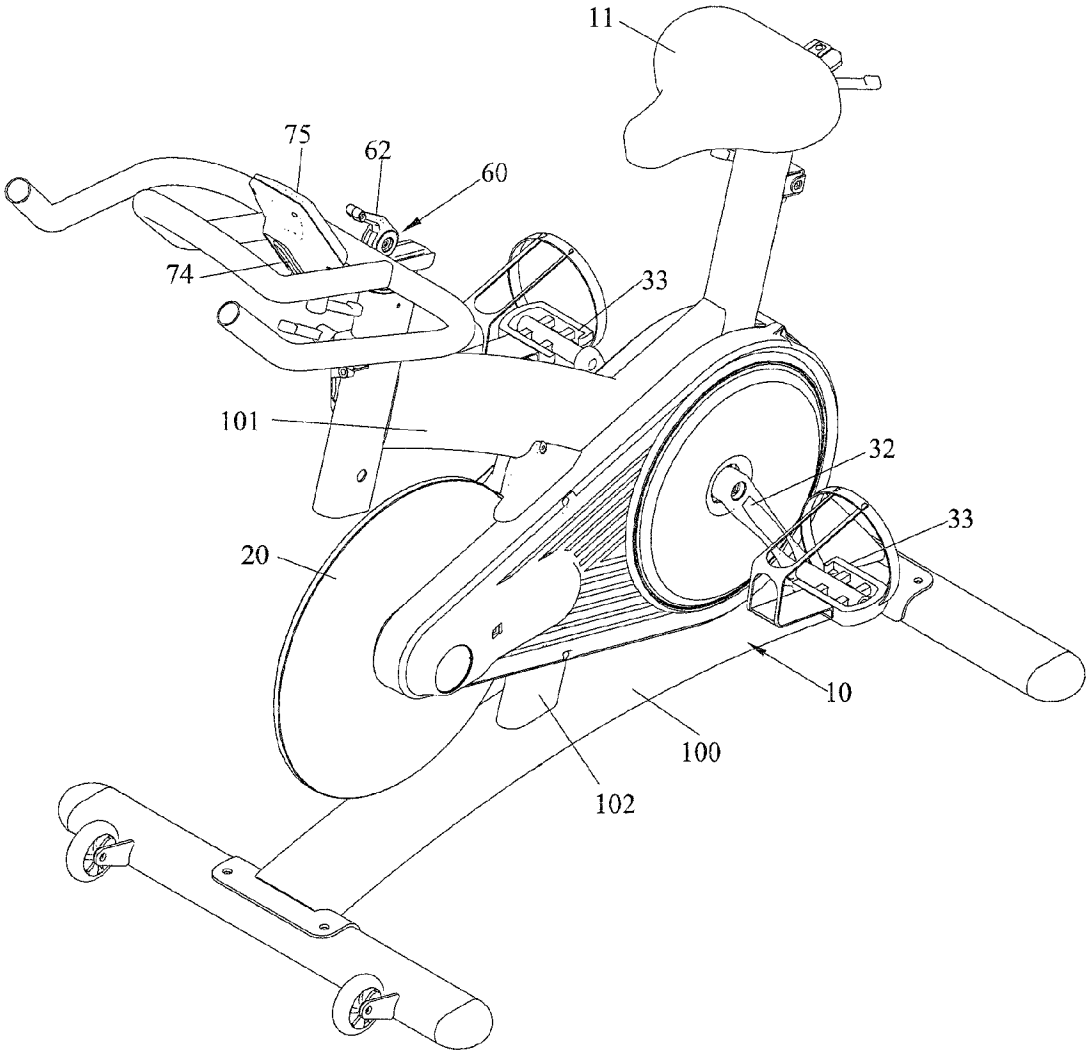
FIG. 7 is an assembled perspective schematic drawing of the present invention.

Referring to FIGS. 1 and 7, an embodiment of the exerciser of the present invention is a bike exerciser. There is mainly a seat 11 on the frame assembly 10 and the driving assembly 30 includes two cranks 32 linked by a driving shaft 31 on the frame assembly 10 as well. The distal end of each crank 32 is rotatably connected a pedal 33. The power transmission mechanism 40 includes a primary wheel 41 fixed on the driving shaft 31, a secondary wheel 42 coaxially fixed with the flywheel 20, and a transmission belt 43 which loops the primary wheel 41 and the secondary wheel 42 together.

FIGS. 1, 2 and 7 show an embodiment of the present invention. There are two beams 12 each having one unrestrained end, and they are parallel to each other and horizontally fixedly allocated on the frame assembly 10. The flywheel 20 is placed in between the two beams 12, and a front shaft 21 is fixed on the center of flywheel 20 and rotatably arranged near the distal ends of the beams 12 for the flywheel 20 to be centered. The guiding rail 52 is fixed on one of the beams 12, so that the guiding rail 52, the sliding unit 53 and the magnetic units 51 are on the single side of the flywheel 20 together. In the drawings of the present invention, one end of the guiding rail 52 points to the axis of the flywheel 20 in order to keep the moving direction of the magnetic units 51 aligning and in parallel with a radius of the flywheel 20. The frame assembly 10 has a base frame 100 and the base frame 100 extends an upwards inclined main support 101 whose middle portion is linked with the middle portion of the base frame 100 by a main brace 102. The other ends of the beams 12 are attached to the middle portion of the main brace 102. Therefore, the center of gravity of the exerciser is much more stable, and the overall design also looks much better and is easier to be assembled and disassembled. The distance between both axis of the primary wheel 41 and the flywheel 20 can be reduced as well.

Referring to FIG. 1, in an embodiment of the present invention, the opposite top and bottom sides of the guiding rail 52 respectively pivotally mounted with a plurality of first rollers 540 whose axis directions are horizontal, and respectively pivotally mounted with a plurality of second rollers 54 whose axis directions are vertical. The sliding unit 53 has a base plate 531 whose two edges extend a bended side plate 532 each respectively corresponding to the top side and bottom side of the guiding rail 52. Each side plate 532 also extends a bended hook plate 533 parallel to the base plate 531. The rollers 54, 540 on top side and bottom side of the guiding rail 52 are respectively located between their corresponding hook plate 533 and the base plate 531. Therefore, these rollers 54 are able to roll on the hook plate 533 and the side plate 532 to make the sliding unit 53 moving along the guiding rail 52 smoother.

Figure 8:
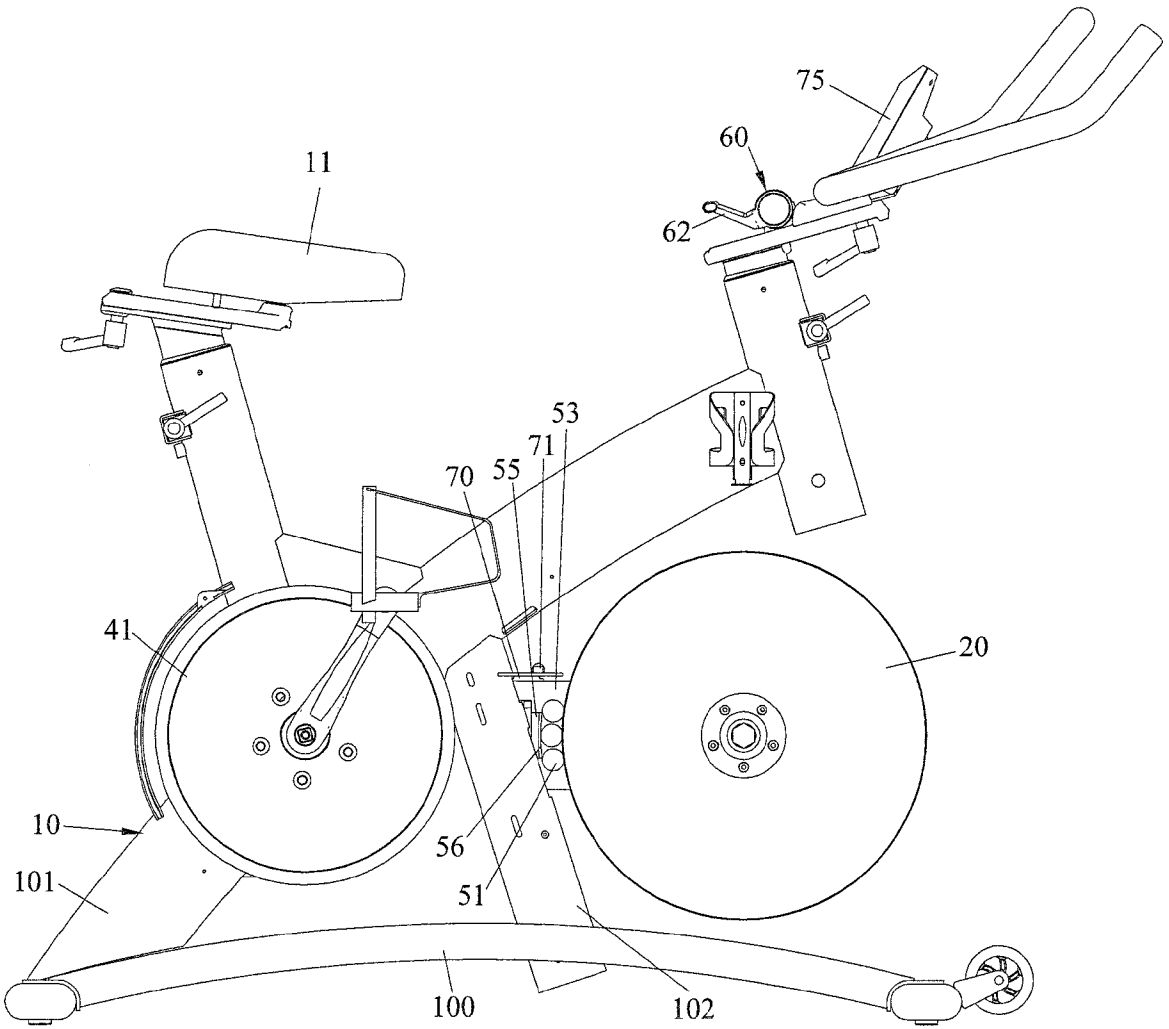
FIG. 8 is an assembled side view of the present invention illustrating the position of the sliding unit corresponding to the flywheel.
Figure 9:
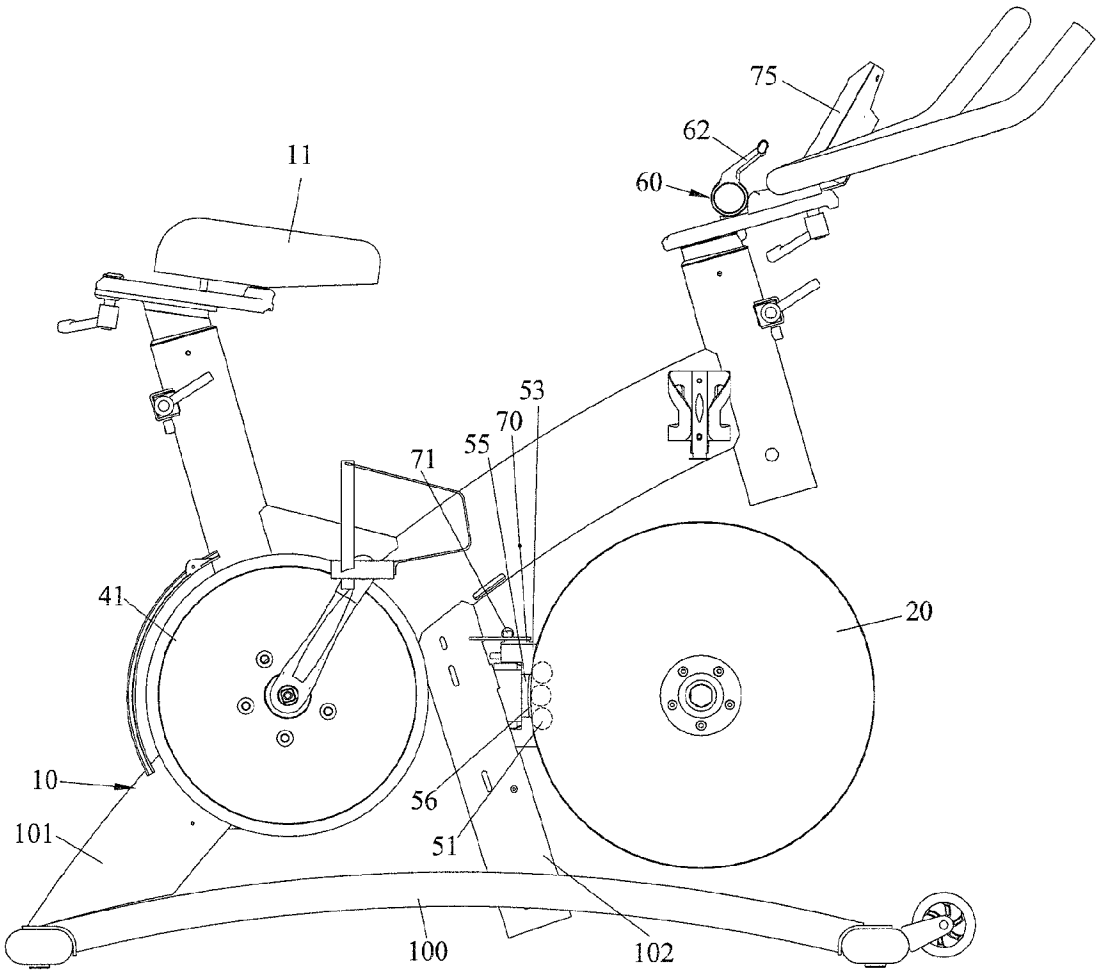
FIG. 9 is an assembled side view of the present invention illustrating another position of the sliding unit corresponding to the flywheel.

Referring to FIGS. 1, 8 and 9, in an embodiment of the present invention, there is a plurality of magnetic units 51. The plural magnetic units 51 are distributed along an arc concentric with the flywheel 20. In the embodiment, when one end of the guiding rail 52 points to the axis of the flywheel 20 and the movement direction of the magnetic units 51 is aligned and in parallel with the radius of the flywheel 20, the moving variation of all magnetic units 51 will be closer to the corresponded flywheel 20 in order to accurately and stably control the resistance variation. In addition, above the magnetic unit 51, a lump 55 is installed on one side of the sliding unit 53, on the lump 55 is a curved groove 550 corresponding to the periphery of the flywheel 20, and there is a brake 56 on the curved groove 550. When the sliding unit 53 gets to the closest point of the flywheel 20, the brake 56 will contact the periphery of the flywheel to produce friction and make the flywheel 20 to stop.

Referring to FIGS. 1~4, 8 and 9, in an embodiment of the present invention, the control mechanism 60 includes a housing 61 fixed on the frame assembly 10, a lever 62 rotatably allocated on the housing 61. Between the housing 61 and the lever 62 are two rubber rings 64. One end of a spring 63 is hooked on to a protruded rod 13 fixed on the main brace 102 of the frame assembly 10, and the other end is hooked on to a thru-hole 534 of the sliding unit 53. The rubber ring 64 causes the housing 61 and the lever 62 to possess a friction resilience which is greater than the elastic force of the spring 63. The lever 62 is interlinked with the sliding unit 53 through a steel rope 65 and both ends of the spring 63 are connected to the frame assembly 10 and the sliding unit 53 respectively, so the lever 62 can pull one end of the sliding unit 53 through the steel rope 65 and the spring 63 can pull the other end of the sliding unit 53. When users apply a force greater than the friction of the rubber ring 64 and the elastic force of the spring 63 to pull the lever 62, the sliding unit 53 will be able to move along the guiding rail 52 and move close to the flywheel 20 (referring to FIG. 9). When the force applied by users is released, the friction of the rubber ring 64 is still greater than the elastic force of the spring 63, so the lever 62 stays at where it is and the sliding unit 53 also keeps still. When users apply a force greater than the friction of the rubber ring 64 to reverse the lever 62, the sliding unit 53 is pulled by the elastic force of the spring 63 to move, along the guiding rail 52 in opposite direction, away from the flywheel 20 (referring to FIG. 8).

Referring to FIGS. 2, 8 and 9, in an embodiment of the present invention, on the sliding unit 53 is a fixed rack 70 and on the frame assembly 10 is a variable resistor 71. The variable resistor 71 has a spindle 72 whose front shaft has a fixed gear wheel 73 engaged with the rack 70. When the sliding unit 53 and the rack 70 are moved together corresponding to the variable resistor 71, the rack 70 will make the spindle 72 to spin through the drive from the gear wheel 73 and change the value of the variable resistor 71. It generates a voltage signal for the signal process unit 74 to process and measure the movement, corresponding to the flywheel 20, of the magnetic units 51 on the sliding unit 53, and then the value of the resistance can be accurately calculated, based upon the measurement of the movement, to be shown on the display 75.

While we have shown and described the embodiment in accordance with the present invention, it should be clear to those skilled in the art that further embodiments may be made without departing from the scope of the present invention.

What is claimed is:

1. An exerciser having magnets adjusting device, comprising:

a frame assembly allowing the exerciser to be firmly placed on a horizontal surface;

a flywheel, with a front shaft, rotatably mounted on the frame assembly; a driving assembly allowing reciprocal force to be applied by users;

a power transmission mechanism provided to transfer the force from the driving assembly to the flywheel, and allowing the flywheel to be rotated corresponding to the frame assembly; and a magnets adjusting device having at least a magnetic unit which will reciprocate with the rotating flywheel to generate magnetic resistance, and comprising:

a guiding rail fixed on the frame assembly, whose top side and bottom side respectively pivotally mounted with a plurality of first rollers having horizontal axis, and respectively pivotally mounted with a plurality of second rollers having vertical axis;

a sliding unit with the at least a magnetic units fixed thereon, mounted on the guiding rail and being able to move along the guiding rail; the sliding unit having a base plate whose two edges extend to a bended side plate, the two side plates respectively corresponding to the top side and bottom side of the guiding rail, each side plate also extending to a bended hook plate parallel to the base plate, the rollers on the top side and the bottom side of the guiding rail respectively located between their corresponding hook plate and the base plate, and the rollers with horizontal axis contacting with the side plate and the rollers with vertical axis contacting with the hook plate; and a control mechanism provided to control the reciprocated movement of the sliding unit along the guiding rail and to control the magnetic units to be linearly moved close to or away from the axis of the flywheel.

2. The exerciser having magnets adjusting device as claimed in claim 1, wherein the frame assembly is provided a seat thereon and linked two cranks by a driving shaft thereon, the distal end of each crank rotatably connected a pedal, the power transmission mechanism includes a primary wheel fixed on the driving shaft and a secondary wheel coaxially fixed with the flywheel, and a transmission belt which loops the primary wheel and the secondary wheel together.

3. The exerciser having magnets adjusting device as claimed in claim 1, wherein the frame assembly includes two beams horizontally allocated in parallel, the front shaft is fixed on the center of flywheel and rotatably arranged near the distal ends of the beams, the guiding rail is fixed on one of the beams, and one end of the guiding rail points to the axis of the flywheel.

4. The exerciser having magnets adjusting device as claimed in claim 1, wherein the control mechanism includes a housing fixed on the frame assembly, a lever rotatably allocated on the housing, at least a rubber ring set between the housing and the lever, the rubber ring causes the housing and the lever to possess a friction resilience which is greater than the elastic force of a spring with two ends respectively connected the sliding unit and the frame assembly, and the lever is interlinked with the sliding unit through a steel rope.

5. The exerciser having magnets adjusting device as claimed in claim 1, wherein at least a magnetic unit is plural and distributed along an arc concentric with the flywheel.

6. The exerciser having magnets adjusting device as claimed in claim 1, wherein the sliding unit is provided a fixed rack thereon, the frame assembly is provided a variable resistor thereon, the variable resistor has a spindle fixed with a gear wheel for engaging with the rack, the rack allows the spindle to spin through the drive from the gear wheel and to change the value of the variable resistor when the sliding unit and the rack are moved corresponding to the variable resistor, so that the variable resistor generates a voltage signal for a signal process unit to process and measure the movement, corresponding to the flywheel, of the magnetic units on the sliding unit.

7. An exerciser having magnets adjusting device comprising:

a frame assembly includes two fixed parallel beams, allowing the exerciser to be firmly placed on a horizontal surface;

a flywheel, with a front shaft, rotatably mounted on the ends of the two beams of the frame assembly;

a driving assembly allowing reciprocal force to be applied by users;

a power transmission mechanism having a power-input end linked with the driving assembly and a power-output end linked with the flywheel, allowing the force applied by users to be transferred by the driving assembly, through the power transmission mechanism to the flywheel, and allowing the flywheel to be rotated corresponding to the frame assembly; and a magnets adjusting device having at least a magnetic unit which will reciprocate with the rotating flywheel to generate magnetic resistance, and comprising:

a guiding rail fixed on one of the beams on the frame assembly, and one distal end of the guiding rail pointing to the axis of the flywheel;

a sliding unit, with the at least a magnetic units fixed thereon, mounted on the guiding rail and being able to move along the guiding rail; and a control mechanism provided to control the reciprocated movement of the sliding unit along the guiding rail and to control the magnetic units to be linearly moved close to or away from the axis of the flywheel, and including a housing fixed on the frame assembly, a lever rotatably allocated on the housing, a rubber ring set between the housing and the lever, the rubber ring causing the housing and the lever to possess a friction resilience which is greater than the elastic force of a spring with two ends respectively connecting the sliding unit and the frame assembly, the lever interlinked with the sliding unit through a steel rope.

8. The exerciser having magnets adjusting device as claimed in claim 7, wherein the top and bottom sides of the guiding rail respectively have a plurality of rollers with horizontal axis and a plurality of rollers with vertical axis, the sliding unit has a base plate whose two edges extend to a bended side plate, the two side plates are respectively corresponding to the top and bottom sides of the guiding rail, each side plate also extends to a bended hook plate parallel to the base plate, the rollers on the top side and the bottom side of the guiding rail are respectively located between the corresponding hook plate and the base plate, the rollers with horizontal axis contact with the side plate and the rollers with vertical axis contact with the hook plate.

9. The exerciser having magnets adjusting device as claimed in claim 7, wherein two beams are horizontally allocated in parallel on the frame assembly, the front shaft is fixed on the center of the flywheel and arranged near the distal ends of the beams, the guiding rail is fixed on one of the beams, and one end of the guiding rail points to the axis of the flywheel.

10. The exerciser having magnets adjusting device as claimed in claim 7, wherein at least a magnetic unit is plural and distributed along an arc concentric with the flywheel.

11. An exerciser having magnets adjusting device comprises:

a frame assembly allowing the exerciser to be firmly placed on a horizontal surface;

a flywheel, with a front shaft, rotatably mounted on the frame assembly;

a driving assembly allowing reciprocal force to be applied by users;

a power transmission mechanism having a power-input end linked with the driving assembly and a power-output end linked with the flywheel, allowing the force applied by users to be transferred by the driving assembly, through the power transmission mechanism to the flywheel, and allowing the flywheel to be rotated corresponding to the frame assembly; and a magnets adjusting device having at least a magnetic unit which will reciprocate with the rotating flywheel to cut across the magnetic field and to generate magnetic resistance, and comprising:

a guiding rail fixed on the frame assembly, and the opposite sides of the guiding rail having a plurality of rollers;

a sliding unit having a rack and the at least a magnetic units to be fixed thereon, the frame assembly provided with a variable resistor thereon, the variable resistor having a spindle, a gear wheel fixed on the spindle to engage with the rack, the rack allowing the spindle to spin through the drive from the gear wheel and to change the value of the variable resistor when the sliding unit and the rack moved corresponding to the variable resistor, and the spin generating a voltage signal for a signal process unit to process and measure the movement, corresponding to the flywheel, of the magnetic units on the sliding unit; and a control mechanism provided to control the reciprocated movement of the sliding unit along the guiding rail and to control the magnetic units to be linearly moved close to or away from the axis of the flywheel.

12. The exerciser having magnets adjusting device as claimed in claim 11, wherein two beams are horizontally allocated in parallel on the frame assembly, the front shaft is fixed on the center of the flywheel and arranged near the distal ends of the beams, the guiding rail is fixed on one of the beams and one end of the guiding rail points to the axis of the flywheel.

13. The exerciser having magnets adjusting device as claimed in claim 11, wherein at least a magnetic unit is plural and distributed along an arc concentric with the flywheel.

14. The exerciser having magnets adjusting device as claimed in claim 11, wherein the at least a magnetic units are magnets.

* * * * *